US012767293B2

(12) United States Patent
Shiue

(10) Patent No.: US 12,767,293 B2
(45) Date of Patent: Oct. 20, 2026

(54) BREATHABLE MASK FOR SNORKELING

(71) Applicant: QBAS Co., Ltd., Taipei City (TW)

(72) Inventor: Chih-Cheng Shiue, Taipei City (TW)

(73) Assignee: QBAS Co., Ltd., Taipei City (TW)

( * ) Notice: Subject to any disclaimer, the term of this patent is extended or adjusted under 35 U.S.C. 154(b) by 652 days.

(21) Appl. No.: 18/341,403

(22) Filed: Jun. 26, 2023

(65) Prior Publication Data

US 2023/0415866 A1 Dec. 28, 2023

Related U.S. Application Data

(60) Provisional application No. 63/356,230, filed on Jun. 28, 2022.

(51) Int. Cl.
*B63C 11/16* (2006.01)

(52) U.S. Cl.
CPC ..... *B63C 11/16* (2013.01)

(58) Field of Classification Search
CPC . B63C 11/12–16; B63C 2011/121–128; B63C 2011/165
See application file for complete search history.

(56) References Cited

U.S. PATENT DOCUMENTS

| | | | | |
|---|---|---|---|---|
| 11,312,457 | B2 | 4/2022 | Vaccaro et al. | |
| 2016/0297505 | A1* | 10/2016 | Caprice | B63C 11/16 |
| 2019/0225311 | A1* | 7/2019 | Barone | B63C 11/16 |
| 2020/0115015 | A1 | 4/2020 | Sang | |

FOREIGN PATENT DOCUMENTS

| | | | | |
|---|---|---|---|---|
| CN | 208683078 U | | 4/2019 | |
| CN | 112046714 A | * | 12/2020 | A63B 33/002 |

* cited by examiner

*Primary Examiner* — Elliot S Ruddie
(74) *Attorney, Agent, or Firm* — MUNCY, GEISSLER, OLDS & LOWE, P.C.

(57) ABSTRACT

A breathable mask for snorkeling having a breathing tube and a body is provided. The breathing tube has an upper end portion and a lower end portion opposite to the upper end portion. The breathing tube has an interior with an intake conduit being formed therein. The upper end portion has an air inlet for inhaled air entering therein. The body is connected to the lower end portion, and includes a main frame, a lens connected with the main frame, a waterproof skirt partially embedded with the main frame and the lens, an exhaust device, and intake and exhaust passages. The exhaust device is independent of the breathing tube, and integrally formed with and extends upward from a side portion of the waterproof skirt. The exhaust device is provided with an exhaust one-way valve for dirty air exhaled by the user to be discharged outwards therethrough.

13 Claims, 8 Drawing Sheets

13d

BREATHABLE MASK FOR SNORKELING

CROSS-REFERENCES TO RELATED APPLICATIONS

This patent application claims the benefit of U.S. Prov. Ser. No. 63/356,230 filed on Jun. 28, 2022, which is incorporated in its entirety by reference.

BACKGROUND OF THE INVENTION

Field of the Invention

The present invention relates to a breathable mask, particularly a full face mask for snorkeling.

Descriptions of the Related Art

In order to allow a user's mouth and nose to breathe freely and avoid the inconvenience of carrying the mask and breathing tube, various full face snorkeling masks (FFSMs) have been developed. In the design of the FFSM, the breathing tube is fixed above the mask body and is in fluid communication with its interior, and the intake and exhaust passages are separated to prevent the fresh air inhaled by the user from mixing with the dirty air (containing $CO_2$) exhaled by the user during the previous breathing cycle as best as possible, so as to achieve the purpose of comfort and safety.

However, in such a typical design, the inhaled air will pass through the breathing tube, the upper chamber (correspondingly covering the user's eyes) and then enter the lower chamber (correspondingly covering the user's nose and mouth) through the intake one-way valve in order for being supplied to the user; whilst, the exhaled air will pass through the exhaust passage formed on the periphery of the body to run half a circle and then enter the breathing tube, and finally run the entire length of the breathing tube before being discharged outwards. In such an arrangement, it is obvious that the exhaust path is obviously much longer than the intake path, resulting in that the user can only increase the amount of exhalation to complete the exhaust action more thoroughly. Such a heavy exhalation must require a heavy inhalation to establish the balance cycle for the inhalation and the exhalation and thus consuming a lot of the user's physical energy.

In order to overcome the above problems, the manufacturer began to think about a design that would shorten the exhaust path. Existing design system is provided to arrange an air outlet of the exhaust passage on the main frame of the mask. Specifically, the exhaust conduit is separated from the breathing tube, so that the breathing tube is only used to serve as a passage for passing inhaling fresh air through, and the air exhaled by the user can directly run half a circle around the periphery of the mask to the air outlet formed on the main frame of the mask before being discharged outwards, without the need of entering the breathing tube, as shown in U.S. Pat. No. 11,312,457.

However, the main problem in this design is that the main frame, lens, and skirt of the snorkel mask must tightly fit one another to achieve waterproof purposes. Under this premise, arranging the air outlet on the main frame and making it communicate with the exhaust passage on the periphery of the body will undoubtedly increase the structural complexity and increase the manufacturing cost, which may, as well, consequently reduce the watertightness of the mask body.

In view of this, solving the above problems has become the unanimous goal of the industry.

SUMMARY OF THE INVENTION

An objective of the present invention is to provide a breathable mask with an exhaust device independent of the breathing tube. Conceptually, the intake method of the breathing tube is left unchanged so that the breathing tube is only an intake passage and no longer has any part to be used for an exhaust passage. In this way, the breathing tube becomes a pure inhaling tube, and the amount of the intake airflow can naturally be increased so that the breathing tube can be designed to be thinner than the conventional breathing tube, thereby making the entire breathable mask lighter.

The part of exhaust is achieved by an exhaust device integrally formed with and extending upwards directly from the exhaust passage arranged on the side of the waterproof skirt (e.g., made of silicone material) along the periphery of the upper chamber. Therefore, compared with the prior art, the exhaust passage of the present invention does not need to be connected to the central breathing tube, but directly connects upwards with the exhaust device from the side of the mask body, so that the exhaust path does not need to extend to the top of the breathing tube, and is independent of the breathing tube, thereby significantly shortening the exhalation path.

Furthermore, the exhaust device of the present invention is integrally formed with and directly extends upwards from the waterproof skirt, and communicates with the exhaust passage formed on the periphery of the mask. This results in reducing the structural complexity and lowering the manufacturing cost. And it does not affect the original structure of the main frame, the lens and the skirt of the mask required to tightly fit one another, thereby still keeping excellent watertightness.

To achieve the above objective, the present invention discloses a breathable mask for snorkeling, which includes a breathing tube and a body. The breathing tube has an upper end portion and a lower end portion opposite to the upper end portion, and the breathing tube further has an interior with an intake conduit being formed therein. The upper end portion has an air inlet for inhaled air entering therethrough and flowing along the intake conduit to the lower end portion. The body is connected to the lower end portion of the breathing tube, and an interior of the body is in fluid communication with the intake conduit. The body includes a main frame, a lens connected with the main frame, a waterproof skirt with at least part being embedded with the main frame and the lens, an exhaust device, an intake passage and an exhaust passage. The waterproof skirt is capable of suitably fitting a face of a user. The waterproof skirt has a partition to divide the interior of the body into an upper chamber and a lower chamber. The exhaust device is independent of the breathing tube, and is integrally formed with and extends upward from a side portion of the waterproof skirt. The intake passage is formed and communicated between the intake conduit and the lower chamber. The exhaust passage formed and communicated between the lower chamber and the exhaust device. The exhaust device is provided with an exhaust one-way valve for dirty air exhaled by the user to flow therethrough from the lower chamber to be discharged outwards through the exhaust passage and the exhaust device.

In addition, the present invention further discloses a breathable mask for snorkeling, which includes a breathing tube and a body. The breathing tube has an upper end portion and a lower end portion opposite to the upper end portion, and the breathing tube further has an interior with an intake conduit being formed therein. The upper end portion has an air inlet for inhaled air entering therethrough and flowing along the intake conduit to the lower end portion. The body is connected to the lower end portion of the breathing tube, and an interior of the body is in fluid communication with the intake conduit. The body includes a main frame, a lens connected with the main frame, a waterproof skirt with at least part being embedded with the main frame and the lens, two exhaust devices, an intake passage and two exhaust passages. The waterproof skirt is capable of suitably fitting a face of a user. The waterproof skirt has a partition to divide the interior of the body into an upper chamber and a lower chamber. The two exhaust devices are independent of the breathing tube, and each of two exhaust devices is integrally formed with and extends upward from a side portion of the waterproof skirt. The intake passage is formed and communicated between the intake conduit and the lower chamber. Each of the two exhaust passages is correspondingly formed and communicated between the lower chamber and one of the two exhaust devices. Each of the two exhaust devices is provided with an exhaust one-way valve for dirty air exhaled by the user to flow therethrough from the lower chamber to be discharged outwards through the two exhaust passages and the two exhaust devices.

DESCRIPTION OF THE PREFERRED EMBODIMENT

Figure 1A:
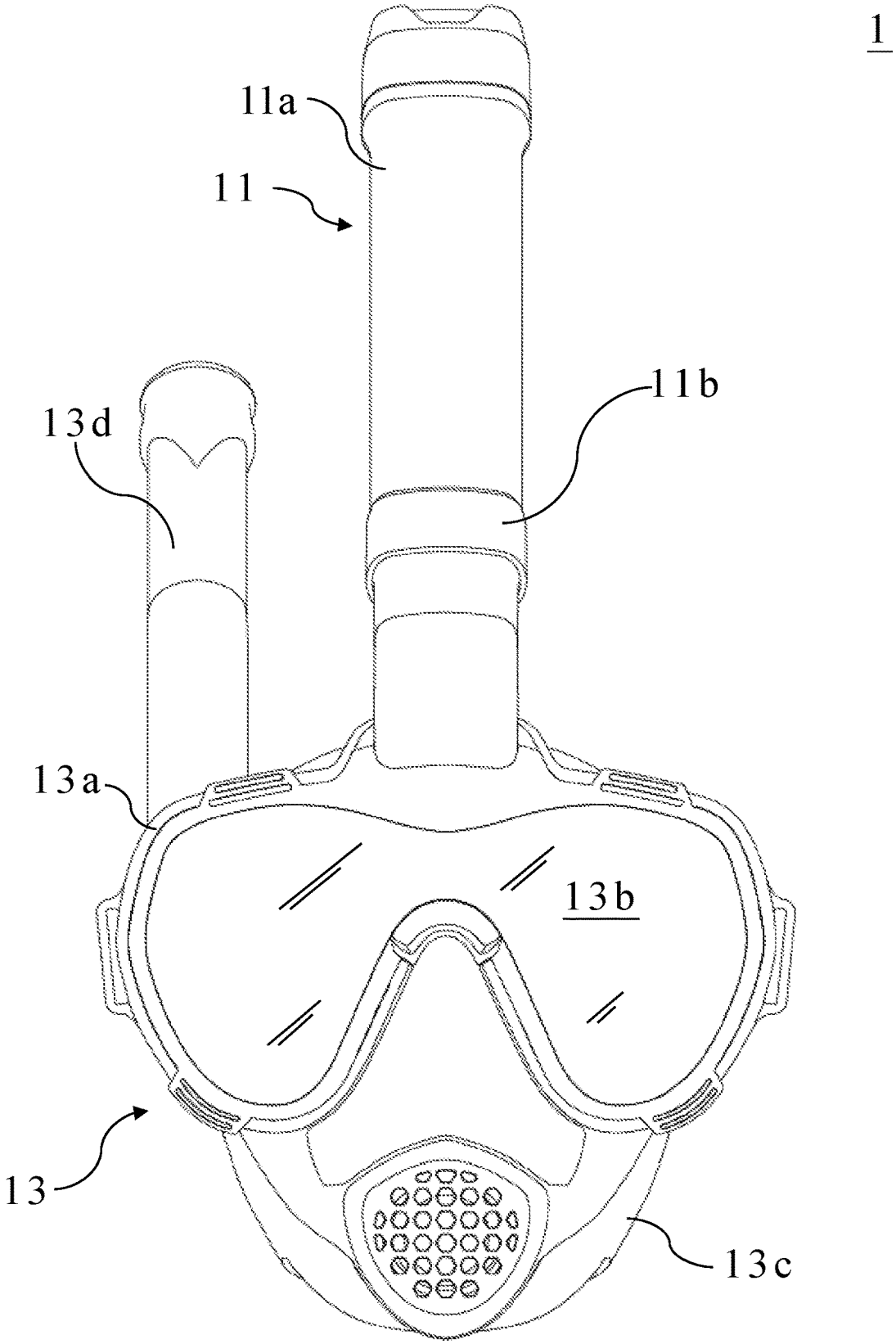
FIG. 1A is a front view of the first embodiment of the breathable mask for snorkeling of the present invention.

The content of the present invention will be explained below by way of two embodiments, and the descriptions thereof are for the purpose of illustrating the present invention only, and are not intended to limit the present invention. It shall be appreciated that in each embodiment and the corresponding drawings, elements not directly related to the present invention, or elements (such as the head strap that ties up the user's head) that may influence the comprehension, are omitted from the description. And, the dimensional proportions among individual elements in the drawings are provided only for one of the aspects but not to limit the present invention.

Figure 1B:
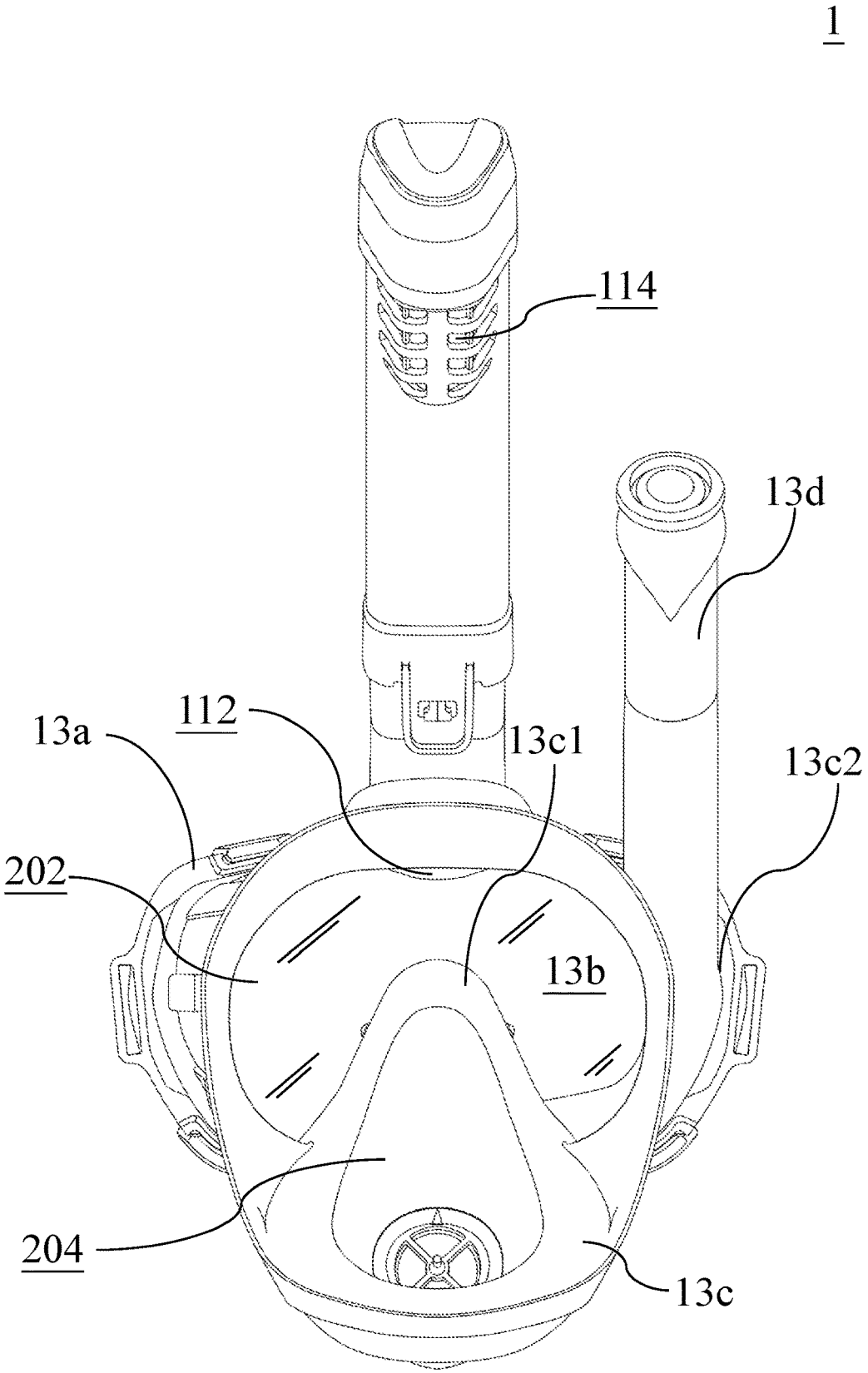
FIG. 1B is a rear view of FIG. 1A.

The first embodiment of the present invention is shown in FIGS. 1A-1E. FIG. 1A illustrates a front view of a breathable mask 1 for snorkeling, and FIG. 1B illustrates a rear view of the breathable mask 1. The breathable mask 1 includes a breathing tube 11 and a body 13. The breathing tube 11 has an upper end portion 11*a* and a lower end portion 11*b* opposite to the upper end portion 11*a*. The breathing tube 11 has an interior with an intake conduit 112 formed therein. The upper end portion 11*a* has an air inlet 114 for inhaled air to enter therethrough and flow along the intake conduit 112 to the lower end portion 11*b*.

The body 13 is connected to the lower end portion 11*b* of the breathing tube 11, and the interior of the body 13 is in fluid communication with the intake conduit 112. Preferably, the body 13 includes a main frame 13*a*, a lens 13*b*, a waterproof skirt 13*c*, an exhaust device 13*d*, two intake one-way valves 13*e*, an intake passage (further described below) and an exhaust passage 132.

The lens 13*b* is connected with the main frame 13*a*. The waterproof skirt 13*c* is at least partially embedded with the main frame 13*a* and the lens 13*b*. The waterproof skirt 13*c* is capable of suitably fitting on a user's face (not shown) and has a partition 13*c*1. As shown in FIG. 1B, the partition 13*c*1 divides the interior of the body 13 into an upper chamber 202 and a lower chamber 204.

When the user wears the breathable mask 1 through a fastening device (which is usually an elastic head strap connecting two sides of the main frame 13*a*, not shown), the partition 13*c*1 is seated on the user's nose, and the user's eyes are accommodated in the upper chamber 202. In addition, depending on the design of the lower chamber of the breathable mask, the waterproof skirt 13*c* can only cover the user's nose (only use the nose to inhale) or cover both the nose and mouth (can use the nose and/or mouth to inhale), so that the nose (or nose and mouth) is accommodated in the lower chamber 204, that is, at least the user's nose is accommodated in the lower chamber 204. This embodiment is illustrated by taking the breathable mask 1 with the lower chamber 204 being capable of accommodating both the user's nose and mouth.

In this embodiment, the exhaust device 13*d* of the breathable mask 1 is a short tube. The exhaust device 13*d* is independent of the breathing tube 11, and is integrally formed with and extending upward from a side portion 13*c*2 of the waterproof skirt 13*c*. Preferably, the exhaust device 13*d* is, but not limited to be used with the same material as the waterproof skirt 13*c* (e.g., silicone). However, it can be integrally formed with the waterproof skirt 13*c*. Since the exhaust device 13*d* is independent of the lens 13*b* and the main frame 13*a*, it will not affect the original structure, in which the main frame 13*a*, the lens 13*b* and the waterproof skirt 13*c* of the mask tightly fit one another, and still can keep excellent watertightness.

The intake passage is formed and communicated between the intake conduit 112 and the lower chamber 204. The exhaust passage 132 is formed and communicated between the lower chamber 204 and the exhaust device 13*d*. The intake passage and the exhaust passage 132 are independent of each other; that is, the intake passage is used to guide the inhaled air from the intake conduit 112 of the breathing tube 11 to the lower chamber 204, and the exhaust passage 132 is used to guide the exhaled air from the lower chamber 204 to the exhaust device 13*d*. As those having ordinary skill in the art can clearly understand the constitution of the intake passage from the hollow airflow line (i.e., the intake path) illustrated in FIG. 1C, the intake passage is not specifically referenced in a numeral in the drawings for clarity and simplicity.

Figure 1C:
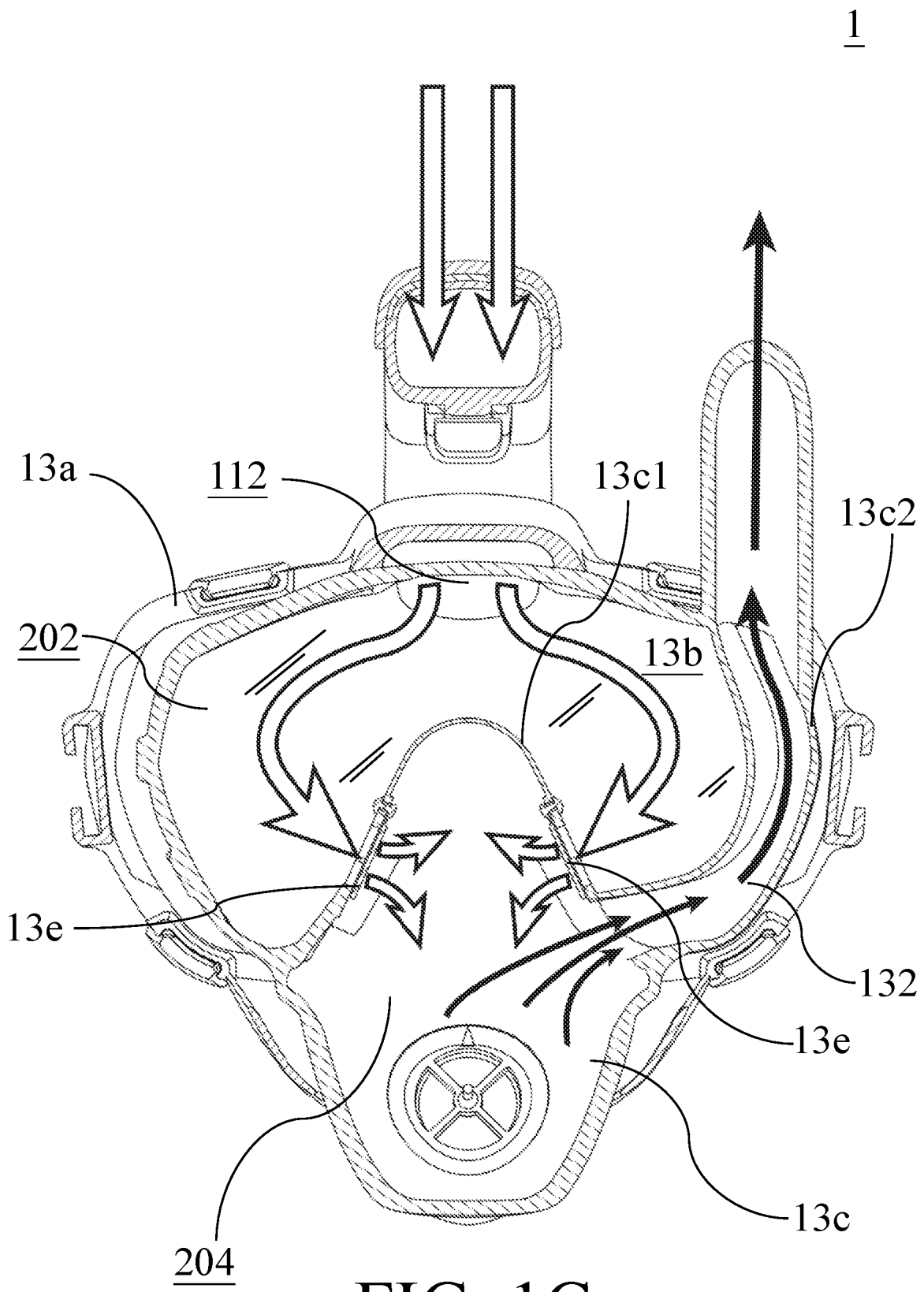
FIG. 1C is a coronal cross-sectional view of FIG. 1B, showing the intake airflow and the exhaust airflow when the user breathes.

FIG. 1C is a coronal cross-sectional view of the breathable mask 1 shown in FIG. 1B. After wearing the breathable mask 1, when the user inhales, fresh air will enter the intake conduit 112 of the breathing tube 11, pass through the upper chamber 202, and then enter the lower chamber 204 through the intake one-way valves 13*e* for the user's nose and/or mouth to inhale, as shown by the hollow airflow lines in FIG. 1C. On the other hand, when the user exhales, the dirty air will flow through the exhaust passage 132 from the lower chamber 204 and then be discharged outwards via the exhaust device 13*d*, as shown by the solid airflow line in FIG. 1C.

Figure 1D:
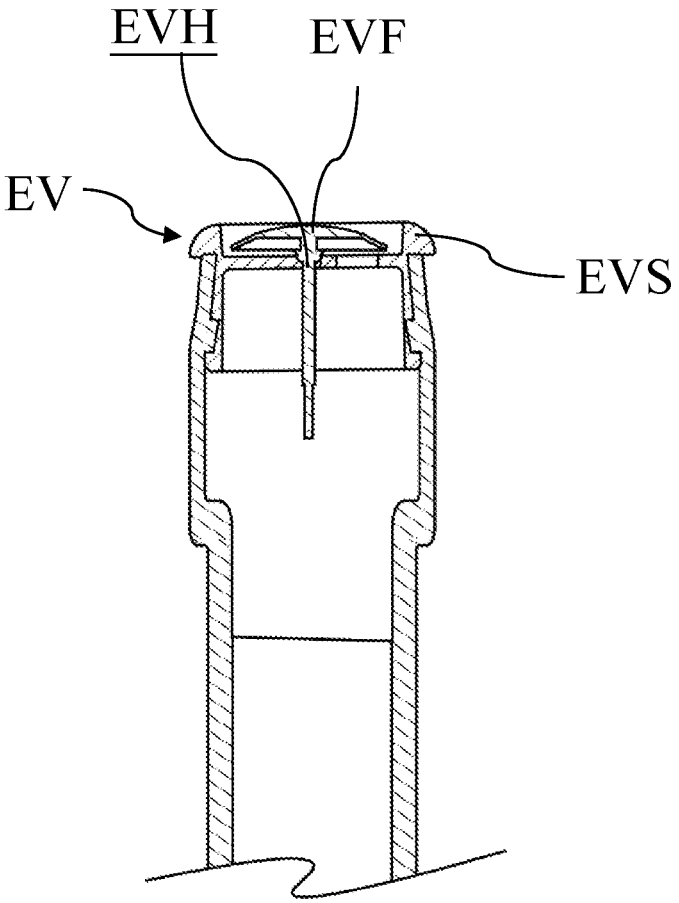
FIG. 1D is a sagittal cross-sectional view of the exhaust device of FIG. 1A.

Further referring to FIG. 1D, the exhaust device 13*d* is provided with an exhaust one-way valve EV for allowing the dirty air exhaled by the user to flow therethrough from the lower chamber 204 and to be discharged outwards through the exhaust passage 132. This way, the exhaust one-way valve EV can prevent the seawater from entering the exhaust device 13*d*. A spoke-wheel seat EVS is provided on a top of the exhaust device 13*d*. The spoke-wheel seat EVS may be made of a rigid material selected from polycarbonate (PC), polyoxymethylene (POM), Acrylonitrile Butadiene Styrene (ABS), Polyvinylchloride (PVC), Polyethylene (PE), Polypropylene (PP) or combinations thereof.

In addition, the exhaust one-way valve EV has a film EVF capable of being airtightly covered on the spoke-wheel seat EVS. The spoke-wheel seat EVS has a central hole EVH for fixing the film EVF. In other words, the exhaust one-way valve EV includes the spoke-wheel seat EVS, the film EVF and the central hole EVH. Besides, in an embodiment, the short tube has an inner diameter, which preferably ranges between 1 and 2 times the inner diameter of the exhaust passage 132, so as to maintain sufficient exhalation pressure and achieve the best exhalation efficiency.

Figure 1E:
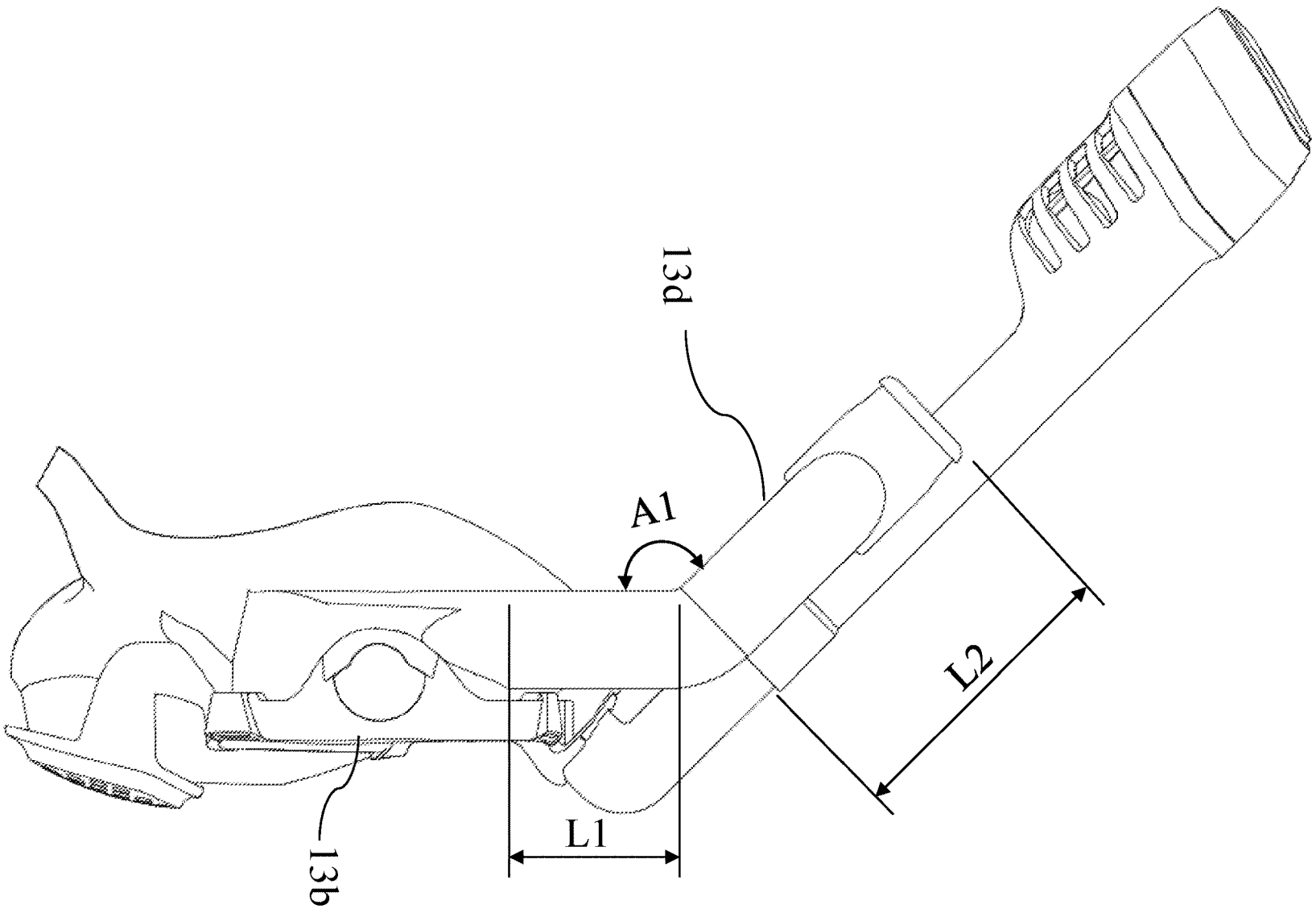
FIG. 1E is a side view of FIG. 1A, defining the length and bending angle of the exhaust device.

As shown in FIG. 1E, the short tube, preferably, has a bent shape and extends in a first length L1 in a direction substantially parallel to a surface of the lens 13*b*, and then extends backwards in a second length L2 by an angle A1. In practice, the first length L1 may range between 10 mm and 100 mm, the second length L2 may range between 10 mm and 100 mm, and the angle A1 may range between 45 degrees and 175 degrees, but they are not limited. In other words, a better design for the angle A1 is to keep the short tube not to be submerged into water easily when the user is in any ways of snorkeling. Under a better angle as mentioned, the length of the short tube can be arranged as short as possible for better exhaust efficiency, provided that the exhaust air bubbles from obstructing the user's view or the noise coming from those bubbles can be well controlled.

Figure 2:
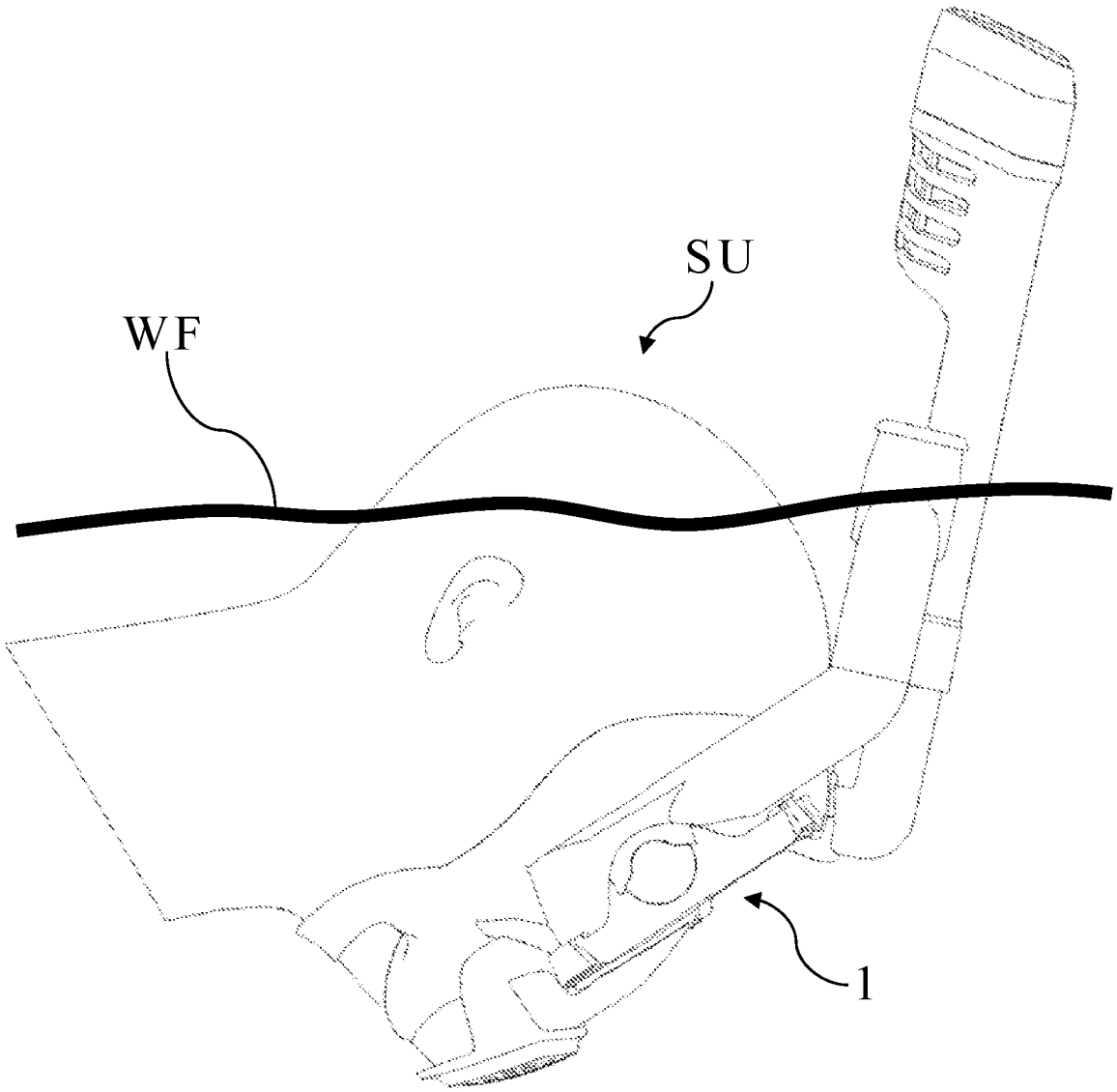
FIG. 2 is a relative position among the user, the breathable mask and the water surface during snorkeling.

FIG. 2 illustrates a state of use when the user SU wears the breathable mask 1, wherein the top of the short tube of the exhaust device 13*d* is just above the water surface WF. In this case, since the exhaust path of the breathable mask 1 of the present invention has been significantly shortened, the breathable mask 1 allows the user SU to exhale more easily than the traditional FFSM, which requires the user to exhale through the whole breathing tube.

It shall be appreciated that, in this embodiment, only one exhaust passage 132 jointly defined by the waterproof skirt 13*c* and an inner surface of the lens 13*b* along an outer periphery of the lens 13*b* is used for illustration; however, in other implementations, the body 13 of the breathable mask 1 may include two exhaust devices, each of which is integrally formed with and extending upward from a side portion of the waterproof skirt 13*c*. In this case, there are two exhaust passages, each of which is jointly defined by the waterproof skirt 13*c* and an inner surface along an outer periphery of the lens 13*b*. In other words, the two exhaust passages are formed on the two sides of the waterproof skirt 13*c*, respectively, and each of them is communicated between the lower chamber 204 and its respective exhaust device.

Figure 3A:
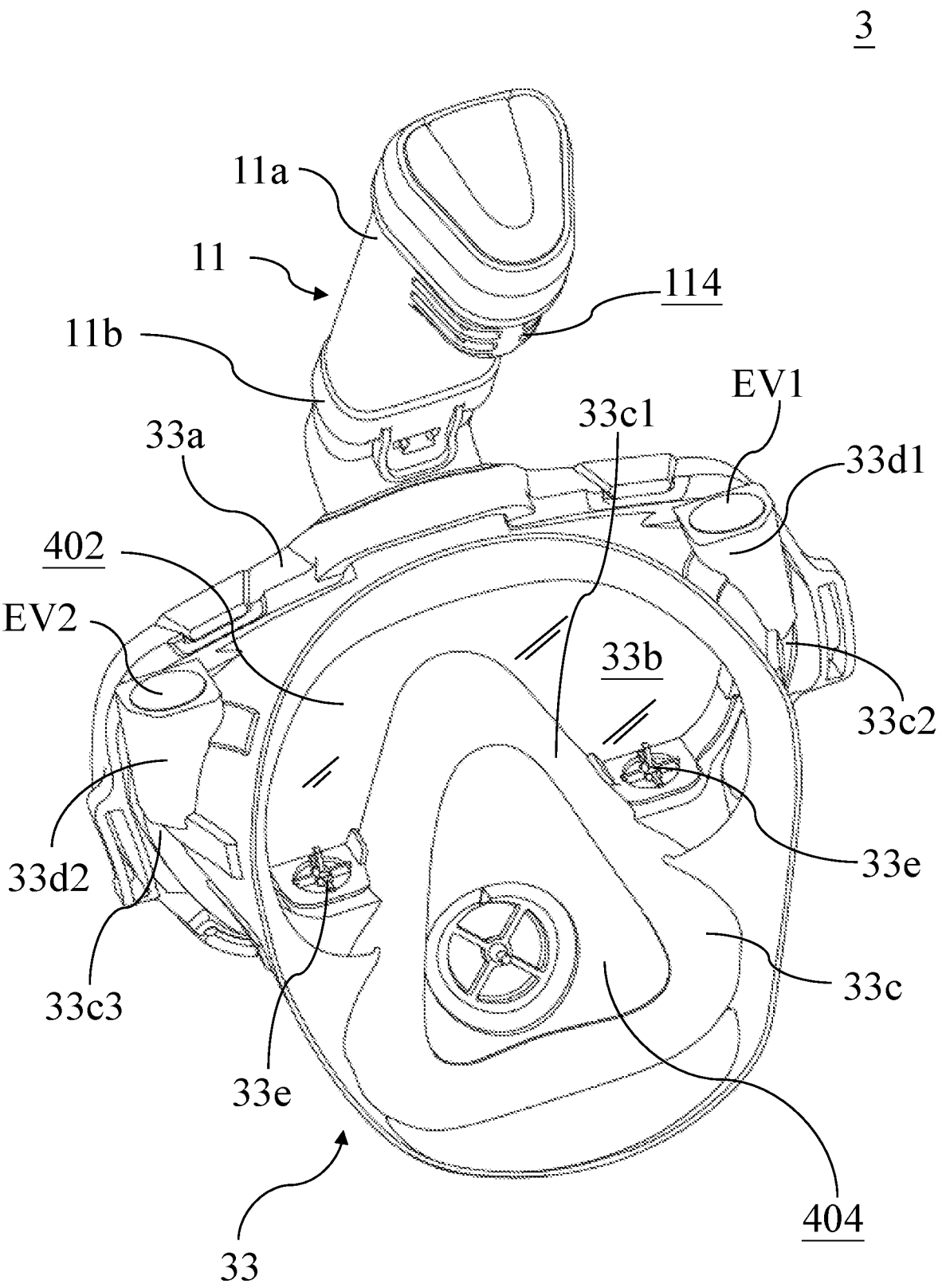
FIG. 3A is a rear perspective view of the second embodiment of the present invention.
Figure 3B:
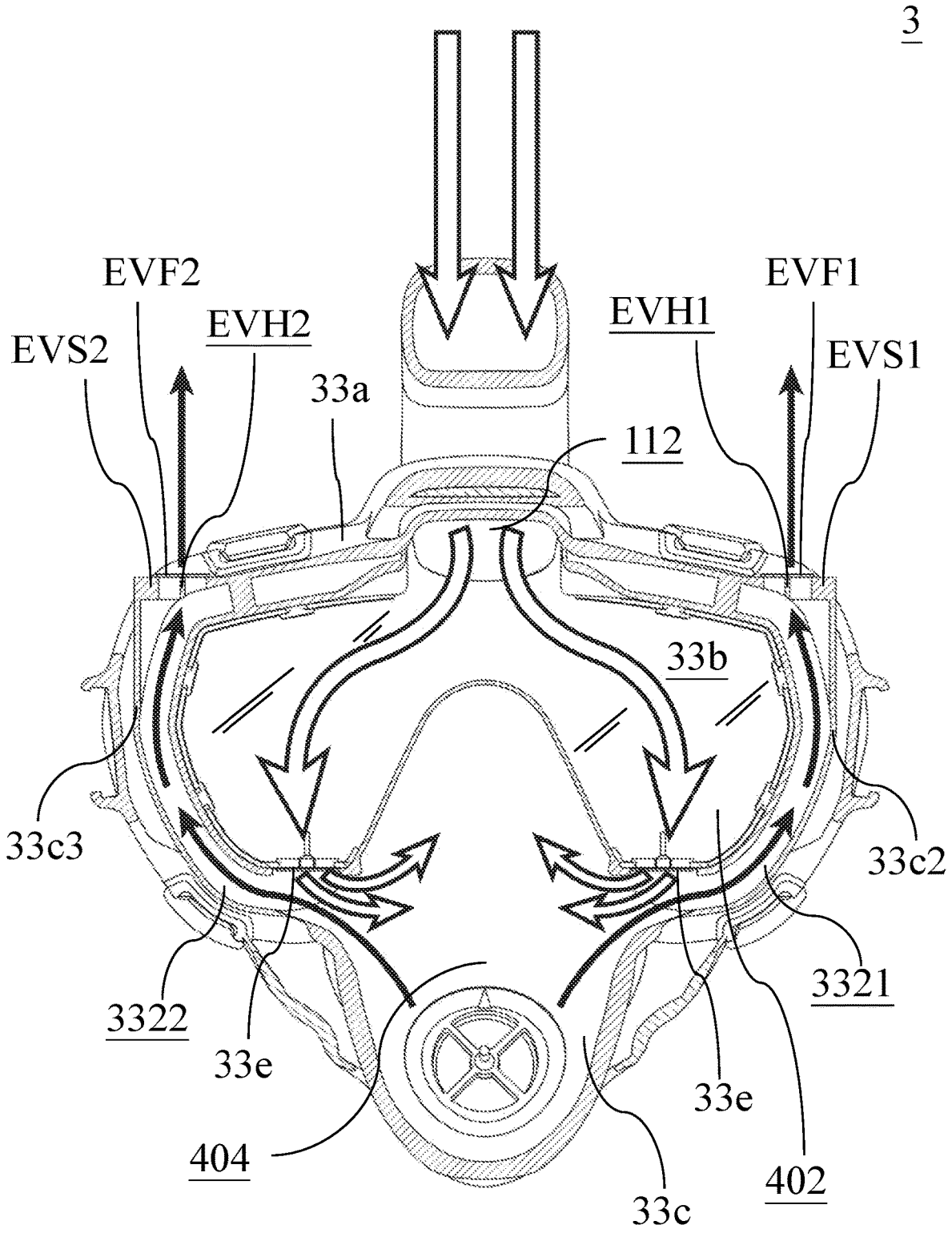
FIG. 3B is a coronal cross-sectional view of FIG. 3A, showing the intake airflow and the exhaust airflow when the user breathes.

A second embodiment of the present invention is shown in FIGS. 3A and 3B. FIG. 3A illustrates a rear side view of a breathable mask 3 for snorkeling, and FIG. 3B is a coronal cross-sectional view of the breathable mask 1 shown in FIG. 3A. The breathable mask 3 includes the breathing tube 11 and a body 33. The body 33 is connected to the lower end portion 11*b* of the breathing tube 11, and the interior of the body 33 is in fluid communication with the intake conduit 112. The body 33 includes a main frame 33*a*, a lens 33*b*, a waterproof skirt 33*c*, two exhaust devices 33*d*1 and 33*d*2, two intake one-way valves 33*e*, an intake passage and two exhaust passages 3321 and 3322.

The lens 33*b* is connected with the main frame 33*a*. The waterproof skirt 33*c* is at least partially embedded with the main frame 33*a* and the lens 33*b*. The waterproof skirt 33*c* is capable of suitably fitting on a user's face (not shown) and has a partition 33*c*1. As shown in FIG. 3A, the partition 33*c*1 divides the interior of the body 33 into an upper chamber 402 and a lower chamber 404.

When the user wears the breathable mask 3 through a fastening device (which is usually an elastic head strap connecting two sides of the main frame 33*a*, not shown), the partition 33*c*1 is seated on the user's nose, and the user's eyes are accommodated in the upper chamber 402. In addition, depending on the design of the lower chamber of the breathable mask, the waterproof skirt 33*c* can only cover the user's nose (in the case only using the nose to inhale) or cover both the nose and mouth (in the case using the nose and/or mouth to inhale), so that the nose (or nose and mouth) is accommodated in the lower chamber 404, that is, at least the user's nose is accommodated in the lower chamber 404. In the breathable mask 3 shown in FIG. 3, both the user's nose and mouth are accommodated in the lower chamber 404.

Different from the breathable mask 1, the breathable mask 3 includes two exhaust devices 33*d*1 and 33*d*2, and the exhaust devices 33*d*1 and 33*d*2 are integrally formed with seats EVS1 and EVS2 directly at the tops thereof, respectively. The exhaust devices 33*d*1 and 33*d*2 are independent of the lens 33*b* and the main frame 33*a*. The exhaust device 33*d*1 is integrally formed with and extends upward from the side portion 33*c*2 of the waterproof skirt 33*c*, and the exhaust device 33*d*2 is integrally formed with and extends upward from the side portion 33*c*3 of the waterproof skirt 33*c*.

As shown in FIG. 3B, the exhaust devices 33*d*1 and 33*d*2 are provided with exhaust one-way valves EV1 and EV2, respectively. In this way, the dirty air exhaled by the user can flow through the exhaust passages 3321 and 3322 and the exhaust devices 33*d*1 and 33*d*2 from the lower chamber 204, and then be discharged outwards from the exhaust one-way valves EV1 and EV2 of the exhaust devices 33*d*1 and 33*d*2.

Preferably, the seats EVS1 and EVS2 are made of the same material as the waterproof skirt 33*c* (e.g., silicone), and are made thicker to increase their rigidity. The exhaust one-way valves EV1 and EV2 have films EVF1 and EVF2, respectively. The films EVF1 and EVF2 are airtightly covered on the seats EVS1 and EVS2, respectively. The seats EVS1 and EVS2 each have a wheel spoke shape, and they have central holes EVH1 and EVH2 for fixing the films EVF1 and EVF2, respectively. In other words, the exhaust one-way valve EV1 includes the spoke-wheel seat EVS1, the film EVF1 and the central hole EVH1, and the exhaust one-way valve EV2 includes the spoke-wheel seat EVS2, the film EVF2 and the central hole EVH2.

In this embodiment, the two seats EVS1 and EVS2 of the exhaust devices 33*d*1 and 33*d*2 are formed by extending directly from the two sides of the eye portion of the waterproof skirt 13*c*. The seats EVS1 and EVS2 are communicated with the exhaust passages 3321 and 3322 on the two sides, respectively. Each of the exhaust passages 3321 and 3322 may be jointly defined by the waterproof skirt 33*c* and an inner surface along an outer periphery of the lens 33*b*. The exhaust passage 3321 is communicated between the lower chamber 204 and the exhaust device 33*d*1, and the exhaust passage 3322 is communicated between the lower chamber 204 and the exhaust device 33*d*2.

After the user wears the breathable mask 3, when the user inhales, fresh air will enter the intake conduit 112 of the breathing tube 11, pass through the upper chamber 402, and then enter the lower chamber 404 through the intake one-way valves 33*e* for the user's nose and/or mouth to inhale, as shown by the hollow airflow lines in FIG. 3B. On the other hand, when the user exhales, the dirty air will flow through the exhaust passages 3321 and 3322 from the lower chamber 404 and then be discharged outwards via the exhaust devices 33*d*1 and 33*d*2, as shown by the solid airflow line in FIG. 3B.

Likewise, in an embodiment, the inner diameter of each of the exhaust device 33*d*1 and 33*d*2 preferably ranges between 1 and 2 times the inner diameter of each of the exhaust passage 3321 and 3322, so as to better maintain sufficient exhalation pressure and achieve the best exhalation efficiency.

It shall be appreciated that, in this embodiment, two exhaust passages 3321 and 3322 jointly defined by the waterproof skirt 33*c* and inner surfaces along two outer peripheries of the lens 33*b* are used for illustration; however, in other implementations, the body 33 of the breathable mask 3 may include only one exhaust device, which is integrally formed with and extending upward from a side portion of the waterproof skirt 33*c*. In this case, there is only one exhaust device and one exhaust passage (e.g., only the exhaust 33*d*1 and the exhaust passage 3321). In other words, the breathable mask of the present invention is not limited by the number and type of the exhaust devices, that is, regardless of whether the exhaust device is a short-tube type or a tubeless type (i.e., a type with a seat), one or more exhaust devices may be arranged on one side, symmetrically on two sides, or in other equivalent ways.

In the first embodiment, the intake one-way valves 13*e* are disposed on the partition 13*c*1 for illustration, whilst in the second embodiment, the intake one-way valves 33*e* are disposed on the two outer sides of the partition 33*c*1 for illustration. However, the type, position and number of the intake one-way valves are not intended to limit the scope of the present invention. In other words, the type and position of the intake one-way valves in the first embodiment and the second embodiment can be interchanged, and these modifications are all within the scope of the present invention.

In summary, the breathable mask of the present invention is provided with an additional exhaust device which is independent of the breathing tube. The exhaust device is made of the same material as the waterproof skirt (e.g., silicone), so that it can be manufactured together with the waterproof skirt and can be integrally formed with the waterproof skirt. Therefore, the arrangement of the exhaust device will not affect the original structure in which the main frame, the lens and the waterproof skirt tightly fit one another, and still can keep excellent watertightness. Furthermore, the air intake method of the breathing tube remains unchanged and the breathing tube becomes a pure inhaling tube, which is only responsible for constituting an intake passage and no longer for providing an exhaust passage. Since there is no need to accommodate the exhaust mechanism, the breathing tube has an increased intake airflow, and on the other hand, can be designed to be thinner than the conventional breathing tube, so that the overall weight of the breathable mask is lighter and the shape design of the top of the breathing tube can be more flexible, variable, and unlimited.

The above embodiments are used only to illustrate the implementations of the present invention and to explain the technical features of the present invention, and are not used to limit the scope of the present invention. Any modifications which can be easily made by those skilled in the art (e.g., the exhaust structure of this invention is applied to a mask with separated left and right lenses or a full-lens FFSM with a lens covering the eyes, nose and mouth) are still the equivalents within the scope of the following claims.

What is claimed is:

1. A breathable mask for snorkeling, comprising:

a breathing tube having an upper end portion and a lower end portion opposite to the upper end portion, the breathing tube further having an interior with an intake conduit being formed therein, wherein the upper end portion has an air inlet for inhaled air entering therethrough and flowing along the intake conduit to the lower end portion; and a body connected to the lower end portion of the breathing tube, and an interior of the body being in fluid communication with the intake conduit, the body comprising:

a main frame;

a lens connected with the main frame;

a waterproof skirt, at least part of the waterproof skirt being embedded with the main frame and the lens, the waterproof skirt being capable of suitably fitting a face of a user; wherein the waterproof skirt has a partition to divide the interior of the body into an upper chamber and a lower chamber;

an exhaust device, being independent of the breathing tube, and integrally formed with and extending upward from a side portion of the waterproof skirt;

an intake passage formed and communicated between the intake conduit and the lower chamber;

an exhaust passage formed and communicated between the lower chamber and the exhaust device; wherein: the exhaust passage is jointly defined by the waterproof skirt and an inner surface along an outer periphery of the lens, and the exhaust device is provided with an exhaust one-way valve for dirty air exhaled by the user to flow therethrough from the lower chamber to be discharged outwards through the exhaust passage and the exhaust device.

2. The breathable mask of claim 1, wherein the exhaust device is independent of the lens and the main frame.

3. The breathable mask of claim 2, wherein the exhaust device is integrally formed with a seat at a top thereof, and the exhaust one-way valve has a film capable of being airtightly covered on the seat; wherein the seat has a wheel spoke shape and a central hole for fixing the film.

4. The breathable mask of claim 3, wherein the exhaust device has an inner diameter ranging between 1 and 2 times an inner diameter of the exhaust passage.

5. The breathable mask of claim 2, wherein the exhaust device is a short tube.

6. The breathable mask of claim 5, wherein the exhaust device is sheathed with a spoke-wheel shaped seat on a top thereof, and the exhaust one-way valve has a film capable of being airtightly covered on the seat; wherein the spoke-wheel seat has a central hole for fixing the film.

7. The breathable mask of claim 5, wherein the short tube has an inner diameter ranging between 1 and 2 times an inner diameter of the exhaust passage.

8. The breathable mask of claim 5, wherein the short tube has a bent shape and extends in a first length in a direction substantially parallel to a surface of the lens, and then extends backwards in a second length by an angle.

9. The breathable mask of claim 8, wherein the first length ranges between 10 mm and 100 mm, the second length ranges between 10 mm and 100 mm, and the angle ranges between 45 degrees and 175 degrees.

10. A breathable mask for snorkeling, comprising:

a breathing tube having an upper end portion and a lower end portion opposite to the upper end portion, the breathing tube further having an interior with an intake conduit being formed therein, wherein the upper end portion has an air inlet for inhaled air entering therethrough and flowing along the intake conduit to the lower end portion; and a body connected to the lower end portion of the breathing tube, and an interior of the body being in fluid communication with the intake conduit, the body comprising:

a main frame;

a lens connected with the main frame;

a waterproof skirt, at least part of the waterproof skirt being embedded with the main frame and the lens, the waterproof skirt being capable of suitably fitting a face of a user; wherein the waterproof skirt has a partition to divide the interior of the body into an upper chamber and a lower chamber; and two exhaust devices, being independent of the breathing tube, and each of two exhaust devices being integrally formed with and extending upward from a side portion of the waterproof skirt;

an intake passage formed and communicated between the intake conduit and the lower chamber;

two exhaust passages, each correspondingly formed and communicated between the lower chamber and one of the two exhaust devices; wherein: each of the two exhaust passage is jointly defined by the waterproof skirt and an inner surface along an outer periphery of the lens, and each of the two exhaust devices is provided with an exhaust one-way valve for dirty air exhaled by the user to flow therethrough from the lower chamber to be discharged outwards through the two exhaust passages and the two exhaust devices.

11. The breathable mask of claim 10, wherein each of the two exhaust devices is independent of the lens and the main frame.

12. The breathable mask of claim 10, wherein each of the two exhaust devices is integrally formed with a seat at a top thereof, and the exhaust one-way valve of each of the two exhaust devices has a film capable of being airtightly covered on the seat; wherein the seat has a wheel spoke shape and a central hole for fixing the film.

13. The breathable mask of claim 12, wherein each of the two exhaust devices has an inner diameter ranging between 1 and 2 times an inner diameter of each of the two exhaust passage.

* * * * *